US011326766B2

(12) United States Patent
Li et al.

(10) Patent No.: US 11,326,766 B2
(45) Date of Patent: May 10, 2022

(54) LED LIGHT WITH SHIFT SWITCH

(71) Applicants: ZHEJIANG YANKON MEGA LIGHTING CO., LTD., Zhejiang (CN); ZHEJIANG YANKON GROUP. CO., LTD., Zhejiang (CN)

(72) Inventors: Yang Li, Zhejiang (CN); Huanliang Wang, Zhejiang (CN); Junhua Fu, Zhejiang (CN); Xuan Zhao, Zhejiang (CN); Bin Yu, Zhejiang (CN)

(73) Assignee: ZHEJIANG YANKON MEGA LIGHTING CO., LTD., Zhejiang (CN)

( * ) Notice: Subject to any disclaimer, the term of this patent is extended or adjusted under 35 U.S.C. 154(b) by 145 days.

(21) Appl. No.: 16/652,412

(22) PCT Filed: Feb. 24, 2020

(86) PCT No.: PCT/CN2020/076334
§ 371 (c)(1),
(2) Date: Mar. 30, 2020

(87) PCT Pub. No.: WO2021/147133
PCT Pub. Date: Jul. 29, 2021

(65) Prior Publication Data

US 2021/0404642 A1 Dec. 30, 2021

(30) Foreign Application Priority Data

Jan. 22, 2020 (CN) ..... 202020145083.4

(51) Int. Cl.
*F21V 23/04* (2006.01)
*F21V 29/70* (2015.01)
(Continued)

(52) U.S. Cl.
CPC ..... *F21V 23/04* (2013.01); *F21K 9/237* (2016.08); *F21V 29/70* (2015.01); *F21Y 2115/10* (2016.08)

(58) Field of Classification Search
CPC ..... F21V 23/04; F21V 29/70; F21Y 2115/10; F21K 9/237; F21K 9/235; F21K 9/232; F21K 9/238; F21K 9/00
See application file for complete search history.

(56) References Cited

U.S. PATENT DOCUMENTS 9,212,801 B2 * 12/2015 Leung ..... F21K 9/23
10,088,112 B2 * 10/2018 Crayford ..... F21V 23/045
(Continued)

FOREIGN PATENT DOCUMENTS

CN 202757033 U 2/2013
CN 103335267 A 10/2013
(Continued)

OTHER PUBLICATIONS

International Search Report dated Jun. 22, 2020 for PCT/CN2020/076334.

*Primary Examiner* — Peggy A Neils
(74) *Attorney, Agent, or Firm* — Yue (Robert) Xu; Apex Attorneys at Law, LLP

(57) ABSTRACT

An LED light with a shift switch related to the technical field of LED lights includes a diffuser, a light body, and a light head sequentially connected from top to bottom. A driving power board and an LED light source board are provided in the light body. A position hole is provided on a side wall of the light body. The driving power board is provided with the shift switch, and the shift switch is provided with a shift handle which passes through the position hole. According to the present application, the effects of reducing the difficulty of modification and replacement and improving the convenience of using the LED light are achieved by controlling the
(Continued)

color temperature, the timing or the light intensity of the LED light by multiple positions of the shift switch.

16 Claims, 8 Drawing Sheets

(51) Int. Cl.
*F21K 9/237* (2016.01)
*F21Y 115/10* (2016.01)

(56) References Cited

U.S. PATENT DOCUMENTS

| | | | | |
|---|---|---|---|---|
| 2011/0163668 | A1* | 7/2011 | Jonsson | F21K 9/23 315/51 |
| 2015/0003026 | A1* | 1/2015 | Lin | F21V 27/00 361/752 |
| 2018/0288847 | A1* | 10/2018 | Halliwell | H05B 45/10 |
| 2021/0018147 | A1* | 1/2021 | Liu | F21K 9/233 |

FOREIGN PATENT DOCUMENTS

| | | | | | |
|---|---|---|---|---|---|
| CN | 104613338 | A | | 5/2015 | |
| DE | 10201131 | A1 | | 8/2003 | |
| JP | 2012234753 | A | | 11/2012 | |
| WO | WO 2019/072114 | | * | 4/2019 | F21K 9/232 |

* cited by examiner

LED LIGHT WITH SHIFT SWITCH

This application is the national phase of International Application No. PCT/CN2020/076334, titled "LED LIGHT WITH SHIFT SWITCH", filed on Feb. 24, 2020, which claims the priority to Chinese Patent Application No. 202020145083.4, titled "LED LIGHT WITH SHIFT SWITCH", filed with China National Intellectual Property Administration, on Jan. 22, 2020, the entire disclosures thereof are incorporated herein by reference.

FIELD

The present application relates to the technical field of LED lights, and in particular to an LED light with a shift switch.

BACKGROUND

Due to the characteristics of high efficiency, energy saving and environmental protection, LED lights have gradually replaced conventional incandescent lights and fluorescent lights, and have been widely used in homes, shopping malls, offices and other places.

Conventional LED lights have the disadvantages of single function and monochrome lighting. With the improvement of people's living standards, the LED lights providing monochrome lighting no longer meet people's needs for life. Therefore, LED lights, having adjustable light intensity and color temperature and timing function, gradually appear on the market.

However, the above LED lights, having adjustable light intensity and color temperature and timing function, currently available on the market are controlled by a switch fixed to the wall or wirelessly connected. Therefore, when the switch is fixed to the wall, the use of these LED lights is affected due to a certain distance between the lighting area of the LED light and the corresponding switch; and when the switch is wirelessly connected, the use of these LED lights is affected because the switch is difficult to find; and, when the original incandescent lights, fluorescent lights or conventional LED lights are replaced by these LED lights, the switch needs to be modified and replaced as well, which increases the replacement cost. Thus, these LED lights need to be improved.

SUMMARY

In view of this, an object of the present application is to provide an LED light with a shift switch to achieve the purpose of reducing the difficulty of modification and replacement and improving the convenience of using the LED light. The technical solution is as follows.

An LED light with a shift switch includes a diffuser, a light body, and a light head sequentially connected from top to bottom. A driving power board and an LED light source board are provided in the light body. Position holes, of which positions correspond to each other, are respectively provided on inner and outer sides of the light body. The driving power board is provided with the shift switch, and the shift switch is provided with a shift handle which passes through the position holes.

Preferably, a mounting block is provided on the inner side of the light body, the mounting block is provided with a switch mounting hole in communication with the position holes in a horizontal direction, and the shift handle passes through the switch mounting hole and the position holes in sequence and extends out of the light body.

Preferably, one side of the mounting block is fixedly connected to the light body, another side of the mounting block is provided with a vertical surface, and the switch mounting hole is arranged perpendicular to the vertical surface.

Preferably, a switch housing is sleeved on the shift handle, the switch housing includes a panel having one side abutting against the vertical surface, and a switch handle sequentially passing through the switch mounting hole and the position holes.

Preferably, a power-board retaining slot matching the driving power board is provided at a bottom of an inner cavity of the light body, and the bottom of the driving power board is fixedly engaged with the power-board retaining slot.

Preferably, the LED light source board is provided with a through hole, an insertion end passing through the through hole is provided at a top of the driving power board, the insertion end is provided with a power-board welding spot, the LED light source board is provided with a light-source board welding spot arranged on one side of the through hole and matching the power-board welding spot, and the power-board welding spot is welded to the light-source board welding spot.

Preferably, a location post is provided at an upper end of the mounting block, and a location hole matching the location post is provided on the LED light source board.

Preferably, a heat sink is inserted at an upper end of the light body, the LED light source board is arranged on an upper side of the heat sink, an insertion end is provided at an upper end of the driving power board, the heat sink is provided with a heat dissipation hole matching the insertion end, and the insertion end is fixed to the LED light source board after sequentially passing through the heat dissipation hole and the LED light source board.

Preferably, the heat sink is provided with a location insertion hole, a mounting post abutting a lower side of the heat sink is provided inside the light body, a location rib sequentially passing through the location insertion hole and the LED light source board is provided at an upper end of the mounting post, and the LED light source board is fixed by a screw bolt which is inserted into the mounting post from top to bottom and screwed to the mounting post.

Preferably, the shift switch is a color temperature shift switch, a timing shift switch or a light intensity shift switch.

Preferably, the shift switch is provided with at least two positions.

It is conceivable from the above solutions that the LED light with a shift switch according to the present application has the following advantages:

The effects of reducing the difficulty of modification and replacement and improving the convenience of using the LED light are achieved by controlling the color temperature, the timing or the light intensity of the LED light by multiple positions of the shift switch on the driving power board.

The effect of improving the control convenience of the shift switch is achieved by providing the mounting block inside the light body to form the vertical surface.

The heat dissipation performance of the LED light is improved by providing the heat sink, which effectively prevents the problem that the service life of the LED light source board and the driving power board inside the LED light is reduced due to excessive temperature.

The stability of the internal connection structure of the LED light is greatly improved by connecting the LED light source board through the location post or by connecting the heat sink with the LED light source board through the location rib, so that the driving power board is fixed inside the light body, and the effect of flexible shifting during the use of the shift switch is thereby achieved.

BRIEF DESCRIPTION OF THE DRAWINGS

In order to illustrate technical solutions in embodiments of the present application or the conventional technology more clearly, drawings to be used in the description of the embodiments or the conventional technology are briefly described below. Apparently, the drawings described below only illustrate some embodiments of the present application, and other drawings may be obtained by those skilled in the art according to the provided drawings without any creative work.

Figure 1:
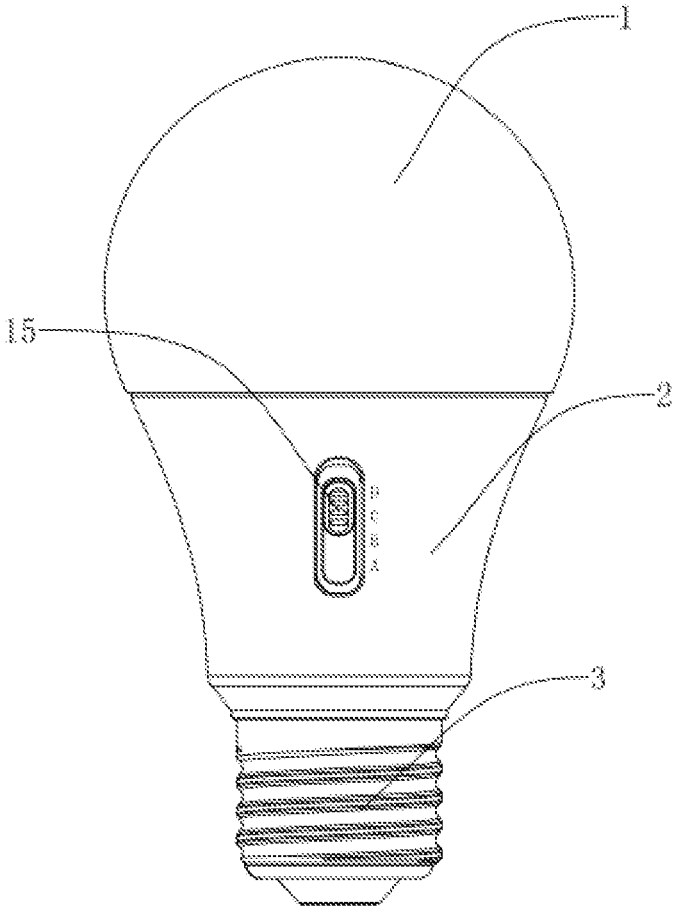
FIG. 1 is a schematic structural view of an LED light according to a first embodiment of the present application.

Reference numerals are listed as follows:

| | |
|---|---|
| 1 diffuser | 2 light body |
| 3 light head | 4 driving power board |
| 5 LED light source board | 6 position hole |
| 7 mounting block | 8 switch mounting hole |
| 9 location post | 10 driving element |
| 11 insertion end | 12 shift switch |
| 13 shift handle | 14 panel |
| 15 switch handle | 16 location hole |
| 17 through hole | 18 power-board retaining slot |
| 19 plastic outer layer | 20 aluminum inner layer |
| 21 light-source board welding spot | 22 heat sink |
| 221 heat dissipation hole | 222 location insertion hole |
| 23 location rib | 24 mounting post. |

DETAILED DESCRIPTION OF THE EMBODIMENTS

The technical solutions according to the embodiments of the present application will be described clearly and completely as follows in conjunction with the drawings in the embodiments of the present application. It is apparent that the described embodiments are only a part rather than all of the embodiments according to the present application. Any other embodiments obtained by those skilled in the art based on the embodiments in the present application without any creative efforts fall within the protection scope of the present application.

First Embodiment

As shown in FIG. 1, an LED light with a shift switch includes a diffuser 1, a light body 2, and a light head 3 which are sequentially connected from top to bottom. The diffuser 1 is fixedly connected to an upper end of the light body 2, and the light head 3 is fixedly connected to a lower end of the light body 2, thus the LED light has a simple structure and is easy to assemble.

Figure 2:
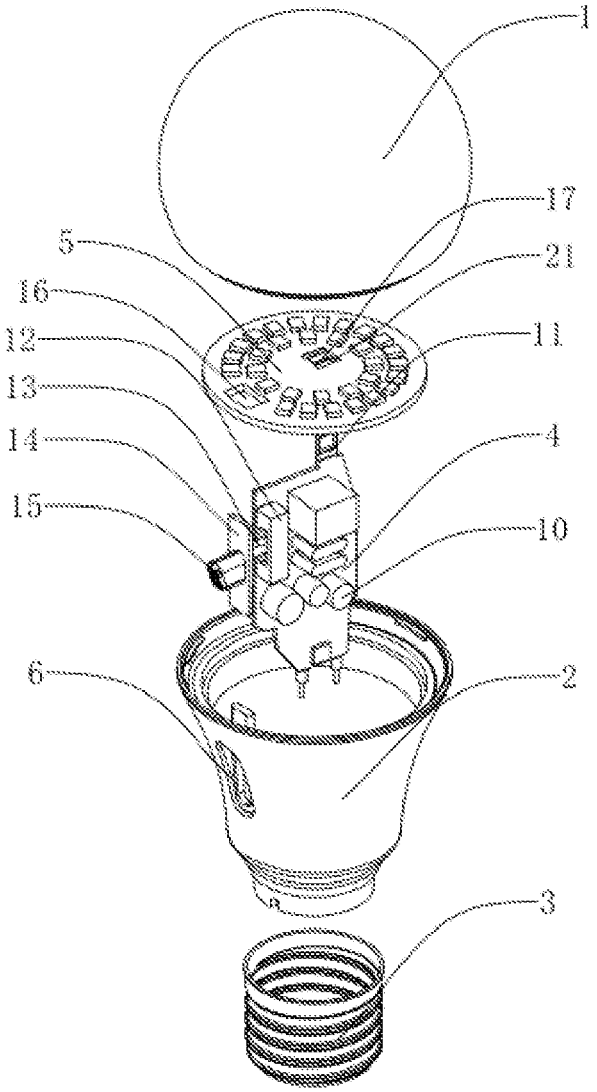
FIG. 2 is a schematic exploded view of the LED light according to the first embodiment of the present application.
Figure 3:
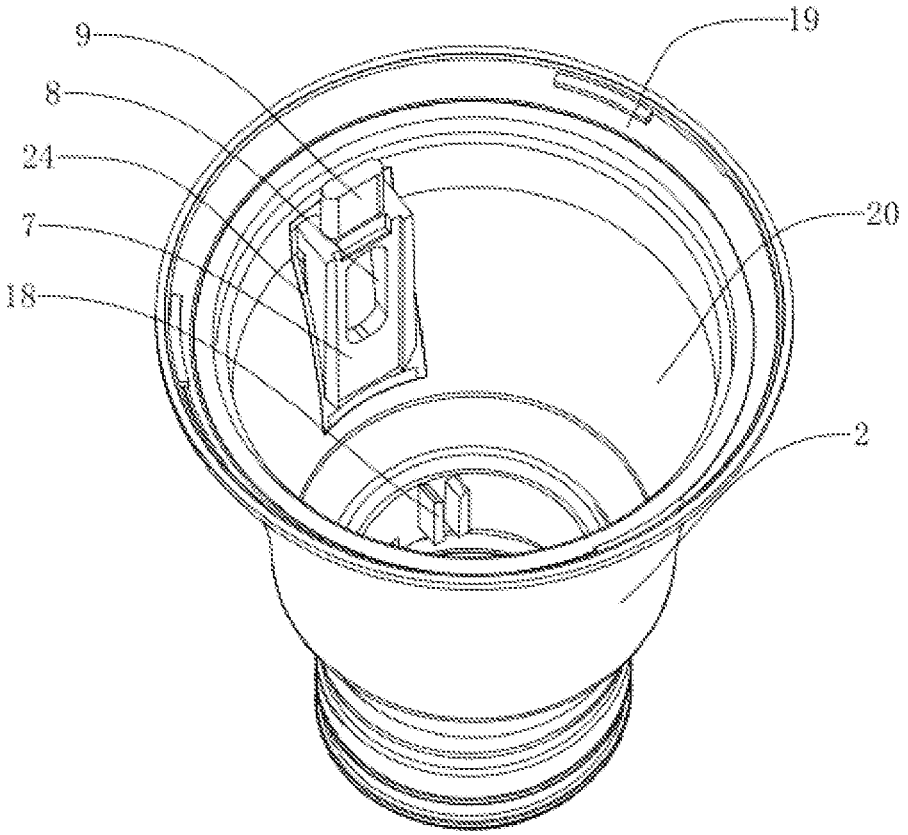
FIG. 3 is a schematic structural view of a light body according to the first embodiment.

As shown in FIGS. 2 and 3, a driving power board 4 and an LED light source board 5 are provided inside the light body 2. The LED light source board 5 is configured to generate a light source, and the driving power board 4 is provided with a driving element 10 for controlling the LED light source board 5. A position hole 6 is provided on a side wall of the light body 2, and the driving power board 4 is provided with a shift switch 12. The shift switch 12 is provided with a shift handle 13 passing through the position hole 6, and a position of the shift switch 12 can be adjusted by driving the shift handle 13 to move. It should be noted that, the shift switch 12 is provided with at least two positions. The shift switch 12 is a color temperature shift switch, a timing shift switch or a light intensity shift switch.

Figure 4:
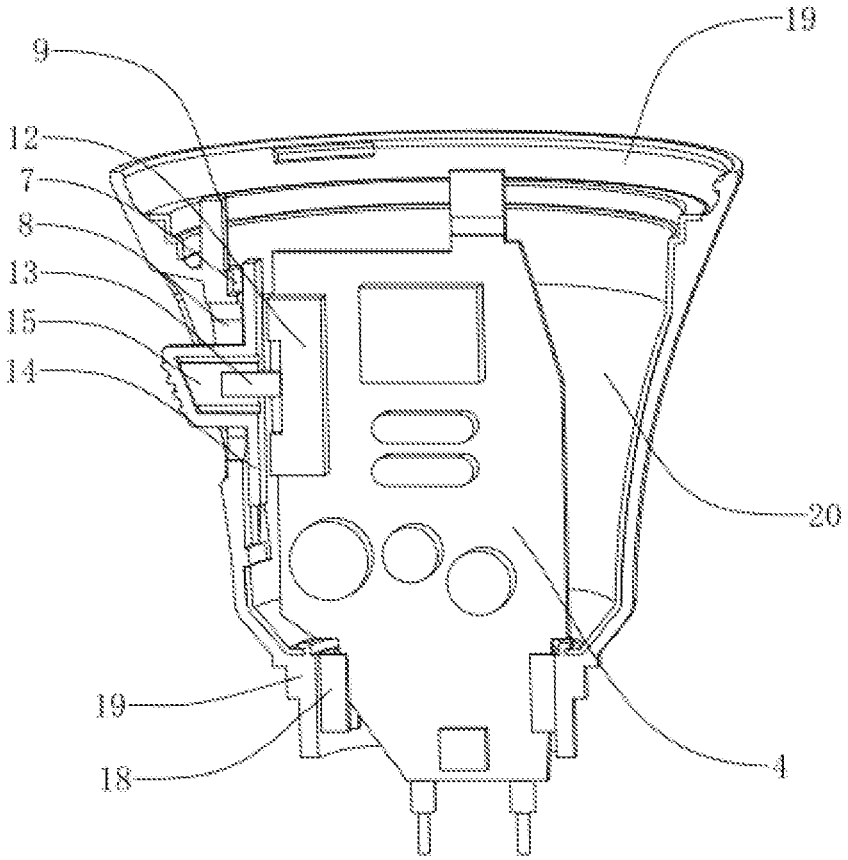
FIG. 4 is a schematic sectional view of a connection structure between the light body and a driving power board according to the first embodiment.

As shown in FIGS. 3 and 4, a mounting block 7 is provided on an inner side of the light body 2. The mounting block 7 is provided with a switch mounting hole 8 in communication with the position hole 6 in a horizontal direction. Correspondingly, the shift handle 13 passes through the switch mounting hole 8 and the position hole 6 in sequence to extend out of the light body 2, so as to allow the shift handle 13 to be driven for position adjustment. It should be mentioned that, one side of the mounting block 7 is fixedly connected to an inner wall of the light body 2, and another side of the mounting block 7 is provided with a vertical surface. The switch mounting hole 8 is perpendicular to the vertical surface. A switch housing is sleeved on the shift handle 13. The switch housing includes a panel 14 having one side abutting against the vertical surface, and a switch handle 15 sequentially passing through the switch mounting hole 8 and the position hole 6. Therefore, when the switch handle 15 is turned to drive the shift handle 13 to shift positions, the panel 14 moves in the vertical plane, thereby significantly improving the control convenience of the shift switch 12. In order to improve the heat dissipation performance of the LED light, a plastic outer layer 19 is further provided on an outer side of the light body 2, and an aluminum inner layer 20 is fixed on an inner side of the plastic outer layer 19. The aluminum inner layer 20 has the characteristics of small specific heat capacity and rapid heat absorption and release, thereby effectively dissipating heat.

Moreover, a power-board retaining slot 18 matching the driving power board 4 is provided at a bottom of an inner cavity of the light body 2. The bottom of the driving power board 4 is fixedly engaged with the power-board retaining slot 18, thereby fixing the bottom of the driving power board 4. In order to fix an upper end of the driving power board 4, the LED light source board 5 is provided with a through hole 17, and an insertion end 11 passing through the through hole 17 is provided at the top of the driving power board 4, and then the upper end of the driving power board 4 can be fixed by the LED light source board 5 after the insertion end 11 is inserted into the through hole 17. It should be mentioned that, the insertion end 11 is provided with a power-board welding spot, and the LED light source board 5 is provided with a light-source board welding spot 21 arranged on one side of the through hole 17 and matching the power-board welding spot. The power-board welding spot is welded to the light-source board welding spot 21, thereby stably connecting the LED light source board 5 with the driving power board 4. In order to further improve the fixation stability of the LED light source board 5, the driving power board 4 and the light body 2, a location post 9 is further provided at an upper end of the mounting block 7. Correspondingly, the LED light source board 5 is provided with a location hole 16 matching the location post 9. By inserting the location post 9 into the location hole 16, a stable connection structure is formed by the LED light source board 5, the light body 2, and the driving power board 4 having the lower end inserted into the power-board retaining slot 18 and the upper end inserted into the LED light source board 5, thereby realizing flexible shifting during use of the shift switch 12.

Second Embodiment

Figure 5:
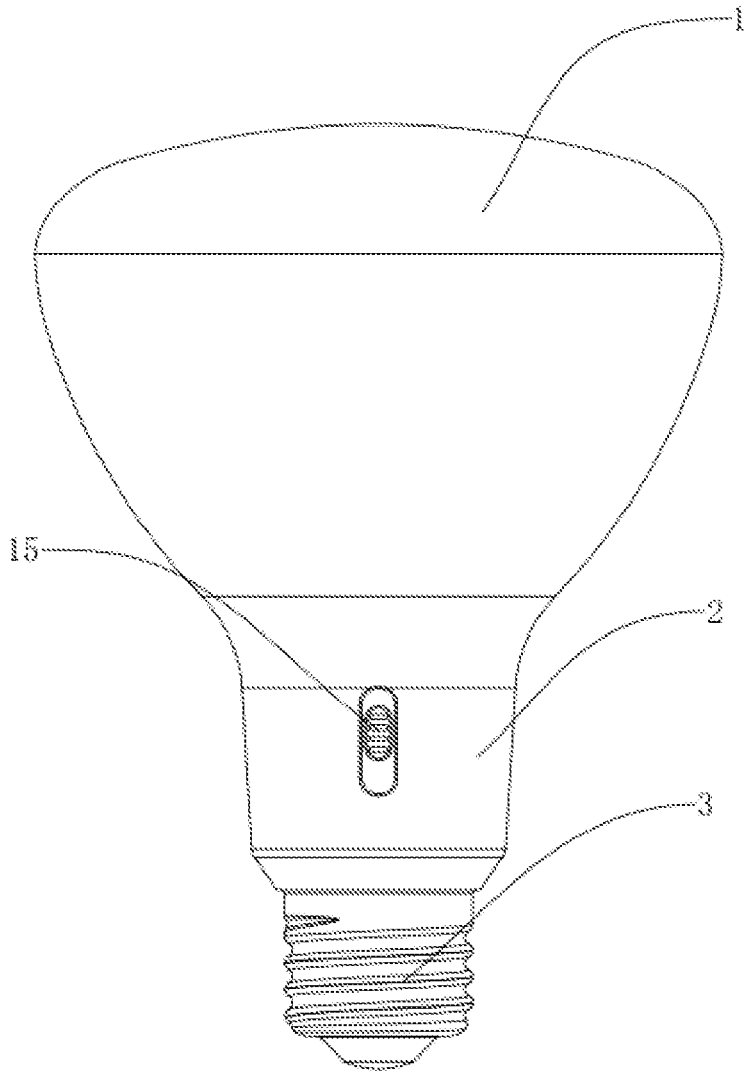
FIG. 5 is a schematic structural view of an LED light according to a second embodiment of the present application.

As shown in FIG. 5, an LED light with a shift switch includes a diffuser 1, a light body 2, and a light head 3 which are sequentially connected from top to bottom. The diffuser 1 is fixedly connected to an upper end of the light body 2, and the light head 3 is fixedly connected to a lower end of the light body 2, and thus the LED light has a simple structure and is easy to assemble.

Figure 6:
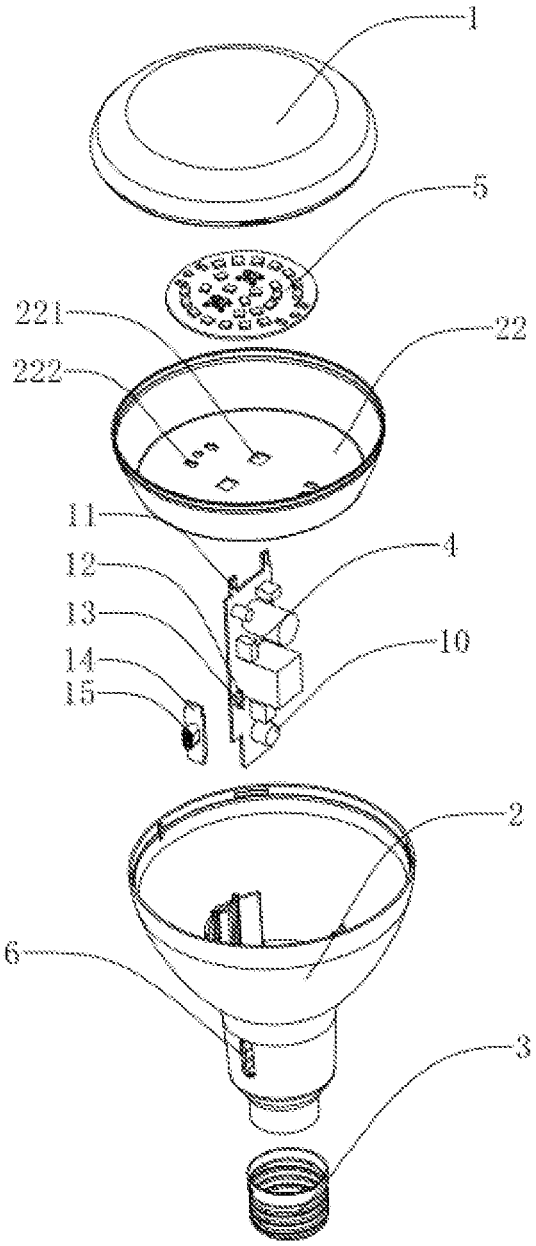
FIG. 6 is a schematic exploded view of the LED light according to the second embodiment of the present application.
Figure 7:
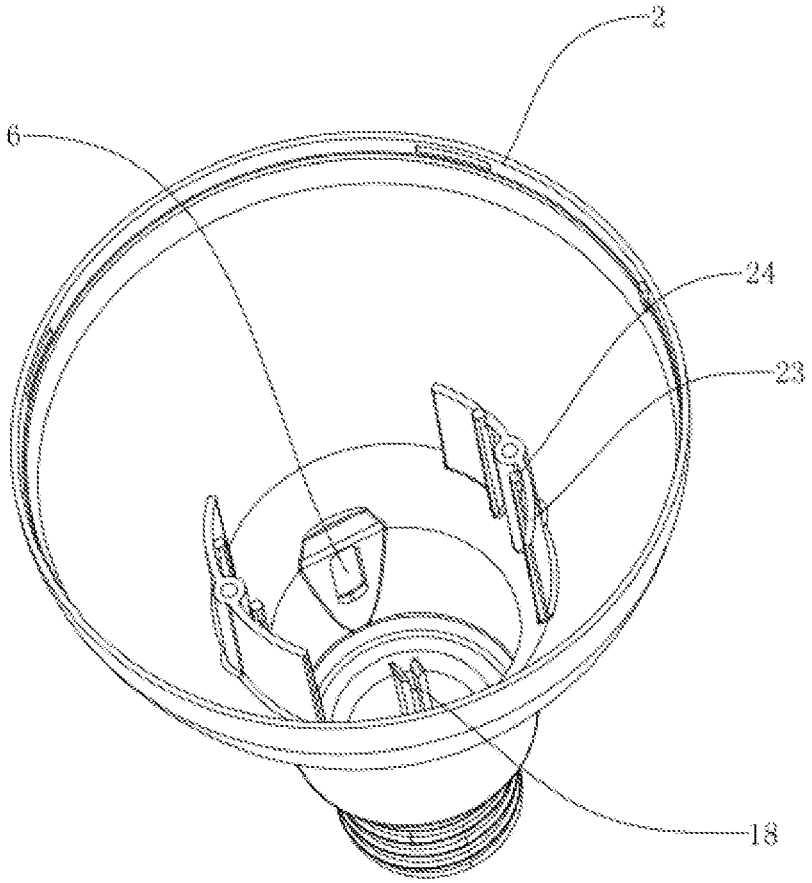
FIG. 7 is a schematic structural view of the light body according to the second embodiment.

As shown in FIGS. 6 and 7, a driving power board 4 and an LED light source board 5 are provided inside the light body 2. The LED light source board 5 is configured to generate a light source, and the driving power board 4 is provided with a driving element 10 for controlling the LED light source board 5. A position hole 6 is provided on a side wall of the light body 2, and the driving power board 4 is provided with a shift switch 12. The shift switch 12 is provided with a shift handle 13 passing through the position hole 6, and a position of the shift switch 12 can be adjusted by driving the shift handle 13 to move. It should be noted that, the shift switch 12 is provided with at least two positions. The shift switch 12 is a color temperature shift switch, a timing shift switch or a light intensity shift switch.

Figure 8:
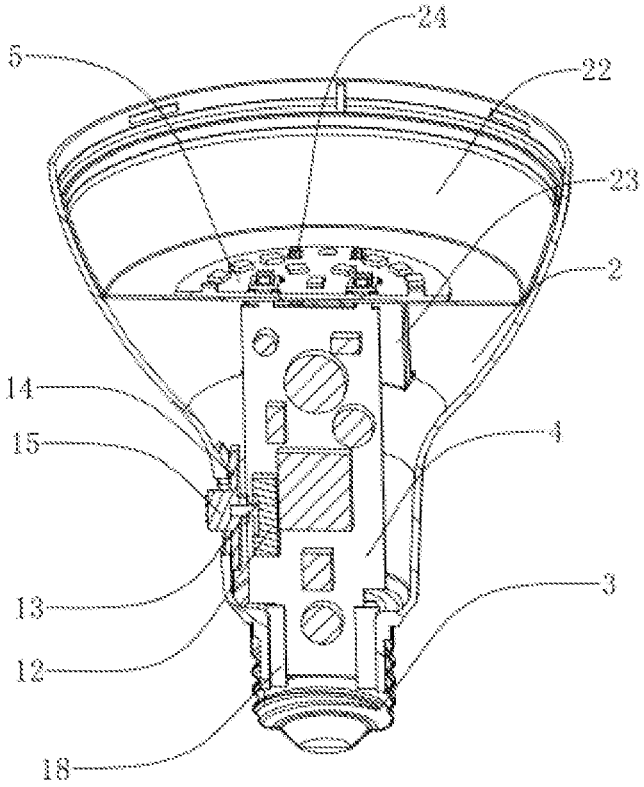
FIG. 8 is a schematic sectional view of a connection structure of the LED light without a diffuser according to the second embodiment.

As shown in FIGS. 7 and 8, a switch housing is sleeved on the shift handle 13. The switch housing includes a panel 14 having one side abutting against an inner side wall of the light body 2, and a switch handle 15 passing through the position hole 6. Therefore, when the switch handle 15 is turned to drive the shift handle 13 to shift positions, the panel 14 moves along the side wall of the light body 2, thereby significantly improving the control convenience of the shift switch 12. It should be noted that, the inner side wall of the light body 2 is a vertical surface.

Moreover, a power-board retaining slot 18 matching the driving power board 4 is provided at a bottom of an inner cavity of the light body 2. The bottom of the driving power board 4 is fixedly engaged with the power-board retaining slot 18, thereby fixing the bottom of the driving power board 4. In order to fix an upper end of the driving power board 4 and provide an effective heat dissipation environment for the LED light source board 5, a heat sink 22 is further inserted at the upper end of the light body 2. The LED light source board 5 is fixed on an upper side of the heat sink 22, and the driving power board 4 is arranged at a lower side of the heat sink 22. An insertion end 11 is provided on the upper end of the driving power board 4. The heat sink 22 is provided with a heat dissipation hole 221 matching the insertion end 11, and the insertion end 11 sequentially passes through the heat dissipation hole 221 and the LED light source board 5 and then is fixed to the LED light source board 5, thereby realizing the fixation of the upper end of the driving power board 4 through the heat sink 22 and the LED light source board 5 and realizing flexible shifting during use of the shift switch 12.

It should be mentioned that, the heat sink 22 is provided with a location insertion hole 222. A mounting post 24 abutting a lower side of the heat sink 22 is provided inside the light body 2, and a location rib 23 sequentially passing through the location insertion hole 222 and the LED light source board 5 is provided at an upper end of the mounting post 24. The LED light source board 5 is fixed by a screw bolt which is inserted into the mounting post 24 after passing through the heat sink 22 from top to bottom and screwed to the mounting post 24, thereby realizing a stable connection of the light body 2, the heat sink 22, the LED light source board 5 and the driving power board.

In summary, according to the present application, the effects of reducing the difficulty of modification and replacement and improving the convenience of using the LED light are achieved by controlling the color temperature, the timing or the light intensity of the LED light by multiple positions of the shift switch 12. The effect of improving the control convenience of the shift switch 12 is achieved by the vertical surface inside the light body 12. Moreover, the stability of the internal connection structure of the LED light is greatly improved by connecting the LED light source board 5 through the location post 9 or by connecting the heat sink 22 with the LED light source board 5 through the location rib 23, so that the driving power board 4 is fixed inside the lamp body, and the effect of flexible shifting during the use of the shift switch 12 is thereby achieved.

Third Embodiment

Compared with the first embodiment, the LED light in the third embodiment is an LED light bulb.

Fourth Embodiment

Compared with the second embodiment, the LED light in the fourth embodiment is a BR light.

Fifth Embodiment

Compared with the fourth embodiment, the LED light in the fifth embodiment is a PAR light.

Terms such as "first", "second", "third", "fourth" and the like (if exists) in the present application are used for distinguishing similar objects, and are unnecessarily used for describing specific orders or sequences. It should be understood that the data used in this way are interchangeable under appropriate circumstances and the embodiments of the application described herein can be implemented in sequences other than those illustrated herein. In addition, the terms "include" and "have" and any variations thereof are intended to cover non-exclusive inclusions. For example, a process, a method, or a device that includes a series of steps or units is not limited to those clearly listed steps or units, and may instead include other steps or units not explicitly listed or inherent to the process, method, or device.

It should be noted that, the terms "first", "second" and the like are used only for description, and should not be construed as indicating or implying relative importance or implying the number of the indicated technical features. Thus, the features defined by "first", "second" and the like can explicitly or implicitly include one or more the features. In addition, the technical solutions between the various embodiments can be combined with each other, but must be on the basis that those technical solutions can be implemented by a person of ordinary skill in the art. If the combination of technical solutions conflicts or cannot be achieved, it should be considered that such a combination of technical solutions does not exist, and does not fall within the scope of protection claimed by the present application.

The principles and implementations of the present application are clarified with specific embodiments herein. The above description of the embodiments is only intended to assist understanding the method and the key concept of the present application. For those skilled in the art, modification can be made to the specific embodiments and the application scopes based on the concept of the present application, and as above, the specification should not be construed as limitation to the present application.

The invention claimed is:

1. An LED light with a shift switch, comprising a diffuser, a light body, and a light head which are sequentially connected from top to bottom, a driving power board and an LED light source board being provided inside the light body, wherein a position hole is provided on a side wall of the light body, the driving power board is provided with a shift switch, and the shift switch is provided with a shift handle passing through the position hole, a heat sink is inserted at an upper end of the light body, the LED light source board is arranged on an upper side of the heat sink, an insertion end is provided on an upper end of the driving power board, the heat sink is provided with a heat dissipation hole matching the insertion end, and the insertion end is fixed to the LED light source board after sequentially passing through the heat dissipation hole and the LED light source board, the heat sink is provided with a location insertion hole, a mounting post abutting a lower side of the heat sink is provided inside the light body, a location rib sequentially passing through the location insertion hole and the LED light source board is provided at an upper end of the mounting post, and the LED light source board is fixed by a screw bolt which is inserted into the mounting post from top to bottom and screwed to the mounting post.

2. The LED light with the shift switch according to claim 1, wherein a mounting block is provided on an inner side of the light body, the mounting block is provided with a switch mounting hole in communication with the position hole in a horizontal direction, and the shift handle is configured to pass through the switch mounting hole and the position hole in sequence and extend out of the light body.

3. The LED light with the shift switch according to claim 2, wherein one side of the mounting block is fixedly connected to the light body, another side of the mounting block is provided with a vertical surface, and the switch mounting hole is perpendicular to the vertical surface.

4. The LED light with the shift switch according to claim 3, wherein a switch housing is sleeved on the shift handle, the switch housing comprises a panel having one side abutting against the vertical surface, and a switch handle passing through the switch mounting hole and the position hole in sequence.

5. The LED light with the shift switch according to claim 1, wherein a power-board retaining slot matching the driving power board is provided at a bottom of an inner cavity of the light body, and a bottom of the driving power board is fixedly engaged with the power-board retaining slot.

6. The LED light with the shift switch according to claim 5, wherein the LED light source board is provided with a through hole, an insertion end passing through the through hole is provided at a top of the driving power board, the insertion end is provided with a power-board welding spot, the LED light source board is provided with a light-source board welding spot arranged on one side of the through hole and matching the power-board welding spot, and the power-board welding spot is welded to the light-source board welding spot.

7. The LED light with the shift switch according to claim 2, wherein a location post is provided at an upper end of the mounting block, and a location hole matching the location post is provided on the LED light source board.

8. The LED light with the shift switch according to claim 1, wherein the shift switch is a color temperature shift switch, a timing shift switch or a light intensity shift switch.

9. The LED light with the shift switch according to claim 1, wherein the shift switch is provided with at least two positions.

10. The LED light with the shift switch according to claim 2, wherein a power-board retaining slot matching the driving power board is provided at a bottom of an inner cavity of the light body, and a bottom of the driving power board is fixedly engaged with the power-board retaining slot.

11. The LED light with the shift switch according to claim 3, wherein a power-board retaining slot matching the driving power board is provided at a bottom of an inner cavity of the light body, and a bottom of the driving power board is fixedly engaged with the power-board retaining slot.

12. The LED light with the shift switch according to claim 4, wherein a power-board retaining slot matching the driving power board is provided at a bottom of an inner cavity of the light body, and a bottom of the driving power board is fixedly engaged with the power-board retaining slot.

13. The LED light with the shift switch according to claim 3, wherein a location post is provided at an upper end of the mounting block, and a location hole matching the location post is provided on the LED light source board.

14. The LED light with the shift switch according to claim 4, wherein a location post is provided at an upper end of the mounting block, and a location hole matching the location post is provided on the LED light source board.

15. The LED light with the shift switch according to claim 2, wherein the shift switch is a color temperature shift switch, a timing shift switch or a light intensity shift switch.

16. The LED light with the shift switch according to claim 2, wherein the shift switch is provided with at least two positions.

* * * * *